United States Patent [19]

Mullendore et al.

[11] Patent Number: 5,064,462

[45] Date of Patent: Nov. 12, 1991

[54] TUNGSTEN PENETRATOR

[75] Inventors: James A. Mullendore; Susan M. Pegher, both of Towanda, Pa.

[73] Assignee: GTE Products Corporation, Stamford, Conn.

[21] Appl. No.: 600,376

[22] Filed: Oct. 19, 1990

[51] Int. Cl.[5] ..... B22F 9/00

[52] U.S. Cl. ..... 75/248; 102/518; 102/519; 420/430

[58] Field of Search ..... 420/430; 75/248; 102/518, 519

[56] References Cited

U.S. PATENT DOCUMENTS 4,458,599 7/1984 Mullendore et al. ..... 102/517

4,897,117 1/1990 Penrice ..... 75/248

*Primary Examiner*—Robert L. Stoll

*Assistant Examiner*—N. Bhat

*Attorney, Agent, or Firm*—J. Theodosopoulos

[57] ABSTRACT

A W-Ni-Co penetrator has a composition of 90 to 98 weight percent tungsten, the balance being nickel and cobalt, the weight ration of nickel to cobalt being between 1:1 to 9:1.

1 Claim, No Drawings

TUNGSTEN PENETRATOR

This invention concerns armor penetrators. Such penetrators are disclosed in U.S. Pat. Nos. 4,885,031, 4,836,108, 4,784,690, 4,749,410 and 4,458,599.

U.S. Pat. No. 4,885,031 discloses penetrators having a composition of 88 to 98% tungsten, 0.25 to 1.5% ruthenium or rhenium, balance of nickel and iron.

U.S. Pat. No. 4,836,108 discloses compositions of tungsten-nickel, tungsten-molybdenum, tungsten-nickel-iron and tungsten-nickel plus copper, molybdenum, titanium.

U.S. Pat. No. 4,784,690 discloses compositions of at least 90% tungsten, the balance being nickel, iron, copper, cobalt, rhenium, ruthenium.

U.S. Pat. No. 4,749,410 discloses compositions of tungsten-nickel plus iron, copper or cobalt.

A penetrator in accordance with this invention has a composition of 90 to 98 weight percent tungsten, the balance being nickel and cobalt, the weight ratio of nickel to cobalt being between 1:1 to 9:1. The advantage of a penetrator having this composition is that it resists bending moments, thereby desirably reducing limit velocity. Limit velocity refers to the velocity needed to penetrate a target.

We believe that this composition has improved resistance to bending for the following reasons.

It is believed that a reduced grain size enhances the resistance to bending. In liquid phase sintering, the matrix liquifies and saturates with tungsten. When the solubility of tungsten in the Ni/Co matrix has reached its maximum, the small tungsten particles will dissolve and reprecipitate out on the larger tungsten particles. Growth of the tungsten grains will continue by particle coalescence. To reduce the grain size, the liquid-solid interfacial energy must be reduced. Cobalt is believed to decrease the liquid-solid interfacial energy by decreasing the solubility of tungsten in the matrix. Therefore, a tungsten penetrator having a composition as per this invention will have enhanced resistance to bending.

In one example, the W—Ni—Co alloy consisted of, by weight percent, 93 tungsten, 5.6 nickel, 1.4 cobalt. Bars were isostatically pressed from this composition at about 35 KSI and were then solid state sintered at 1420° C. for three hours to achieve densification of over 90%. The bars were then liquid phase sintered at 1530° C. for 45 minutes to develop heavy alloy structure. The bars were then heat treated at 1200° C. in vacuum for three hours to remove hydrogen.

We claim:

1. A penetrator having a composition of, in weight percent, 93 tungsten, 5.6 nickel, 1.4 cobalt.

* * * * *

UNITED STATES PATENT AND TRADEMARK OFFICE

CERTIFICATE OF CORRECTION

PATENT NO. : 5,064,462

DATED : Nov. 12, 1991

INVENTOR(S) : James A. Mullendore, Susan M. Pegher, Deborah D. Kuntz

It is certified that error appears in the above-identified patent and that said Letters Patent is hereby corrected as shown below:

On the title page:

(75) Inventors: James A. Mullendore; Susan M. Pegher, both of Towanda, Pa.

Should read:

(75) Inventors: James A. Mullendore; Susan M. Pegher, both of Towanda, Pa. and Deborah D. Kuntz, Wyalusing, Pa.

Signed and Sealed this

Sixteenth Day of March, 1993

*Attest:*

STEPHEN G. KUNIN

*Attesting Officer*

*Acting Commissioner of Patents and Trademarks*